US005807020A

United States Patent [19]

Chen

[11] Patent Number: 5,807,020

[45] Date of Patent: Sep. 15, 1998

[54] TRAFFIC GUIDE CONSTRUCTIONS AT ROAD INTERSECTIONS TO PROVIDE SMOOTH TRAFFIC FLOWS AND METHODS OF TRAFFIC CONTROL THEREOF

[76] Inventor: Chien-yuan Chen, Village, Lin 7, Taishan Hsiang, Taipei Hsien, Taiwan

[21] Appl. No.: 714,480

[22] Filed: Sep. 17, 1996

[51] Int. Cl.[6] ..... E01C 1/00

[52] U.S. Cl. ..... 404/1

[58] Field of Search ..... 404/1; 104/125, 104/124, 123; 238/121

[56] References Cited

FOREIGN PATENT DOCUMENTS

| | | | |
|---|---|---|---|
| 1243584 | 9/1960 | France | 404/1 |
| 1364458 | 7/1962 | France | 404/1 |

*Primary Examiner*—Tamara L. Graysay
*Assistant Examiner*—Sunil Singh
*Attorney, Agent, or Firm*—Pro-Techtor Inter-National Services

[57] ABSTRACT

Traffic guide constructions at road intersections to provide smooth traffic flows thereof and the methods of traffic control with these traffic guide constructions mainly include overhead bridges and/or underground tunnels extending in parallel to a main road and one or more branch road intersecting with the main road to cross the intersections thereof so as to avoid traffic jams thereat. Cars may move on the main and the branch roads straight forward without being interrupted at the intersections. Cars moving on the main and the branch roads can make turns to either sides by using the tunnels under the overhead bridges or the turn-arounds above the underground tunnels to avoid interfering with the cars moving straight forward and causing any traffic jams at the intersections. Such traffic guide constructions at road intersections do not need spacious land nor will they be affected by buildings around the intersetions and are therefore suitable for different topographies and spaces to provide smooth traffic flows.

2 Claims, 5 Drawing Sheets

TRAFFIC GUIDE CONSTRUCTIONS AT ROAD INTERSECTIONS TO PROVIDE SMOOTH TRAFFIC FLOWS AND METHODS OF TRAFFIC CONTROL THEREOF

BACKGROUND OF THE INVENTION

The present invention relates to traffic guide constructions at road intersections to provide smooth traffic flows, and more particularly to traffic guide constructions suitable for different topographies and spaces to guide traffic to move through road intersections straightly and smoothly without causing or being stopped by any traffic jam thereat.

There are patents disclosing solutions to provide no interruption at an intersection at a main and a branch roads, one example is U.S. Pat. No. 4,986,692 titled "ROAD INTERSECTION CONSTRUCTION FOR TRAFFIC CONTROL" granted to Yang Yin-Lung on Jan 22, 1991 (hereinafter referred to as "the cited patent").

FIG. 1 of the cited patent illustrates a main road AB which extends from north to south and two branch roads CD, EF which extend from east to west for driving right side. The branch roads CD, EF connect with the main road AB at right angles and their intersections are flat. Safety islands I and J are located at the intersections in such a manner that the longitudinal axes of the safety islands are in parallel with the main road and equally divide the main road to block the cross traffic on the branch roads. Circular detour ways ab, cd, ef, and gh are provided on both sides of the main road near the branch roads. To avoid conflict between cars and motorcycles at the intersections, underground passages for motorcycles or pedestrians are built under the intersections o, p, q, r, s, t, u, and v of the circular detour ways.

The main road AB has four lanes of traffic and arrows 1, 2, 3 and 4 represent the direction of driving on these lanes. Dotted and dashed lines and numerals represent lanes for the cars. It is obvious that the car lanes 2, 3 on the inside can go straight through the intersections without obstruction, but cars on these lanes can not make right turns to branch road CD or EF unless they change lanes to outer lane. They also can not make left or U-turns unless they go around the circular detour way cd or gh and through the tunnel or overhead bridge. The cars on lanes 3 and 4 must go around the circular detour way ef or ab for left or U-turns.

The branch road CD has two lanes 5 and 6. The cars on the lane 5 can make a right turn to the main road AB but it can not make a left turn or proceed straight across the intersection because of the safety islands I and J. The cars must take circular way cd through the tunnel or the overhead bridge then make a right turn to road CD or proceed on the main road AB. The cars on lane 6 similarly must take the circular detour way ab for left or U-turns.

In the cited patent, the circular detour ways ab, cd, ef, and gh are used to avoid traffic jams at the intersections of the branch roads CD and EF and the main road AB and to eliminate traffic signal lights at the intersections. However, following disadvantages exist in the cited patent:

1. The circular detour ways ab, cd, ef, and gh must have big enough curvature and sufficient lanes for cars to safely drive thereon. In other words, the intersections of the main road and the branch roads must be wide enough while there is not any building or structure in the areas where the intersections of the circular detour ways and the branch roads locate to permit the construction of the circular detour ways. Such circular detour ways are not suitable for an intersection which is small and has plenty buildings around it.

2. Since safety islands I, J are used to block the cross traffic on the branch roads, cars running on the branch roads must use the circular detour ways to cross the intersections with the main road. However, since the width and the traffic flow of the branch roads and that of the circular detour ways are not always the same, the circular detour ways tend to have traffic jams at their entrances and even adversely interrupt the smooth traffic on the branch roads. That is, the safety islands preventing the traffic on the branch roads from directly crossing the main road can only solve the traffic jams on the main road at the intersections with the branch roads but not the traffic jams on the branch roads.

3. The construction of tunnels or overhead bridges at two sides of the main road near the intersections with the branch roads and with the circular detour ways is technically complicated and causes the roads to run up and down repeatedly. Moreover, the construction costs shall be very high.

SUMMARY OF THE INVENTION

It is therefore a primary object of the present invention to provide traffic guide constructions at road intersections where have only limited space, so that traffic flows at these intersections can be smoothly guided simply by overhead bridges or underground tunnels.

Another object of the present invention is to provide traffic guide constructions at road intersections to allow cars on both the main and the branch roads to run straight when they pass the intersections and thereby avoids traffic jams on the branch roads caused by the improperly designed circular detour ways.

BRIEF DESCRIPTION OF THE DRAWINGS

The above and other objects, the features and effects of the present invention can be best understood from the following detailed description of the preferred embodiments and the accompanying drawings wherein.

DETAILED DESCRIPTION OF THE PREFERRED EMBODIMENTS

Figure 1:
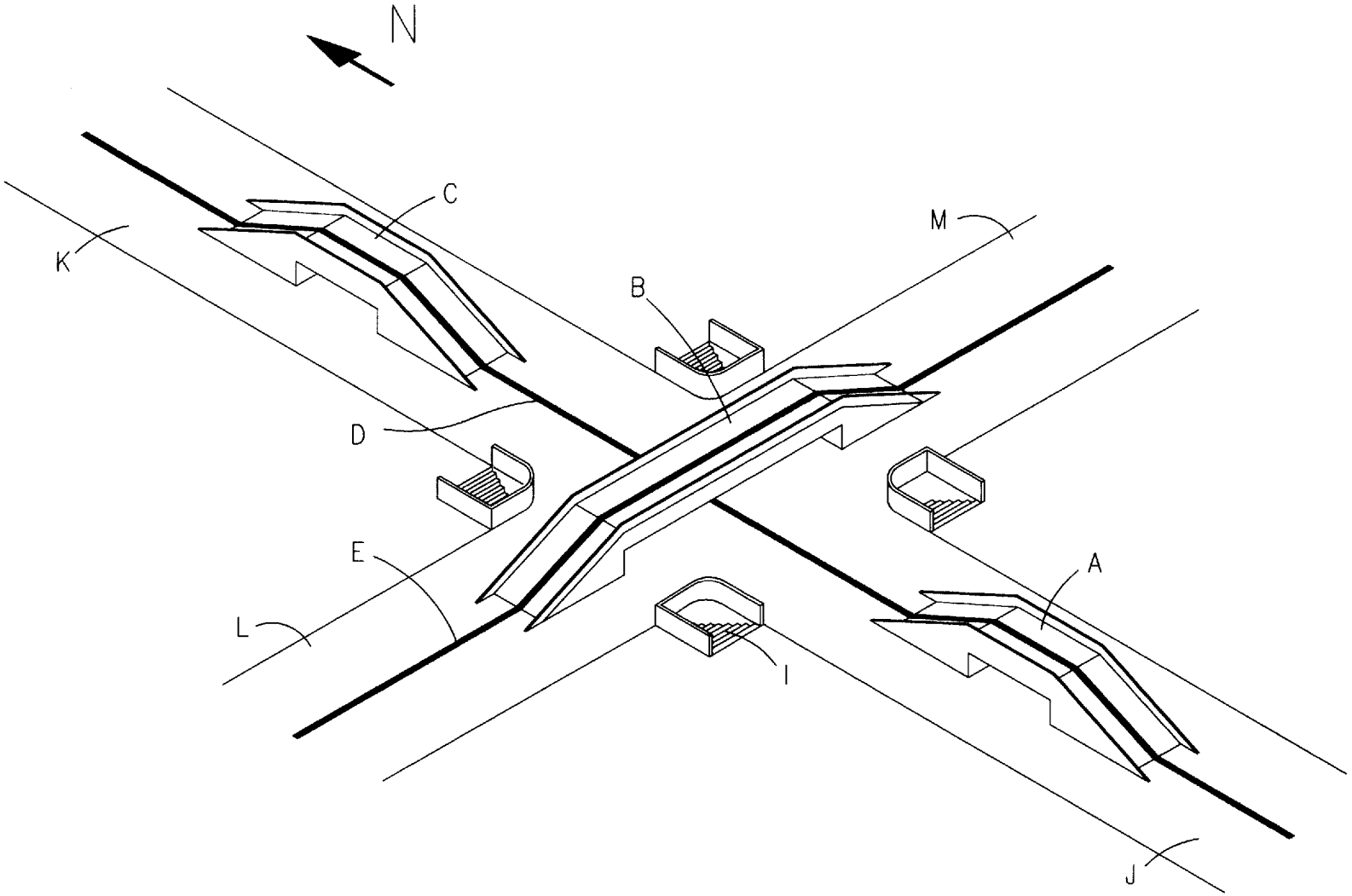
FIG. 1 is a schematic perspective view illustrating a first embodiment of the traffic guide constructions at a road intersection according to the present invention.
Figure 2:
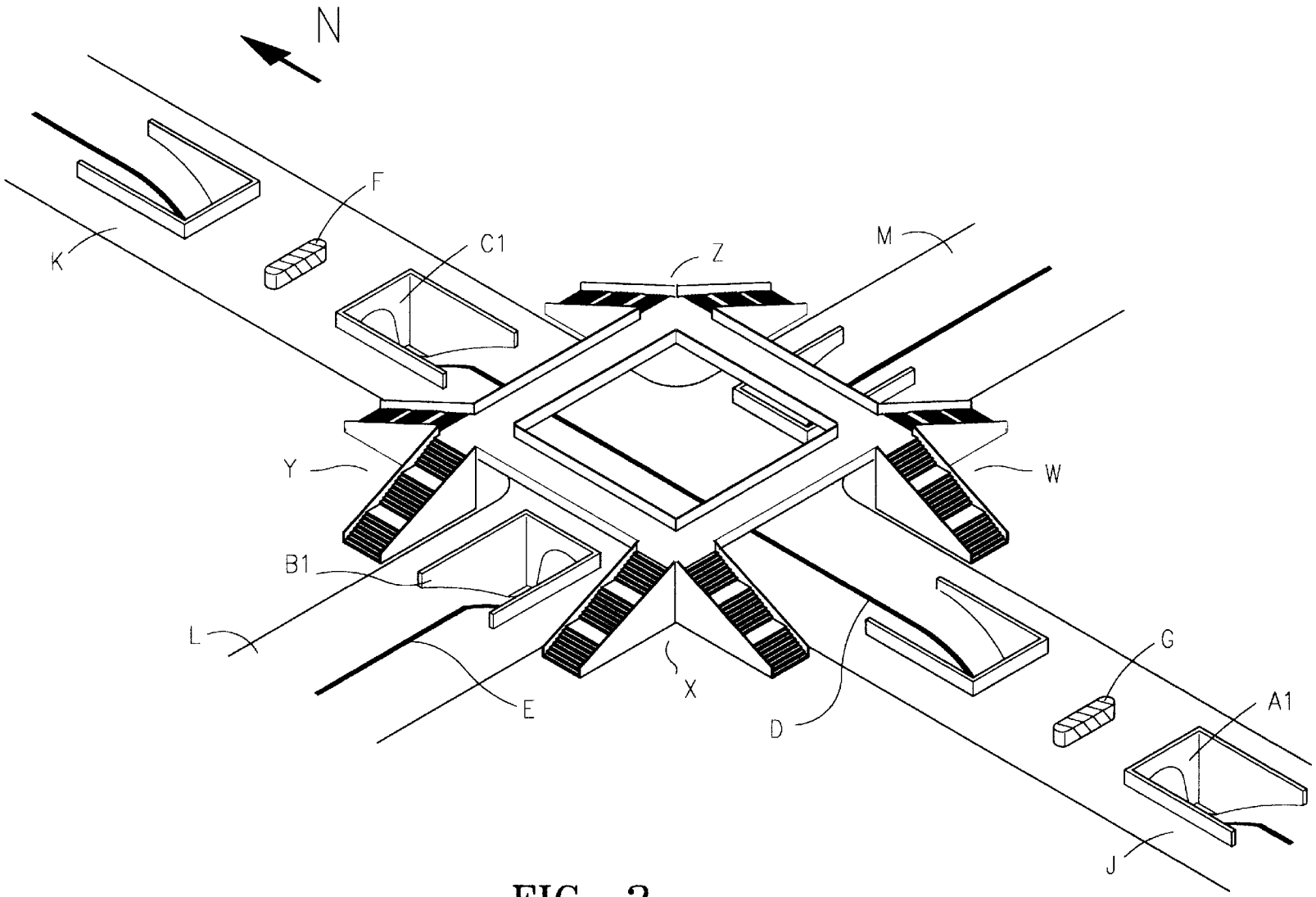
FIG. 2 is also a schematic perspective view illustrating a second embodiment of the traffic guide constructions at a road intersection according to the present invention.
Figure 3:
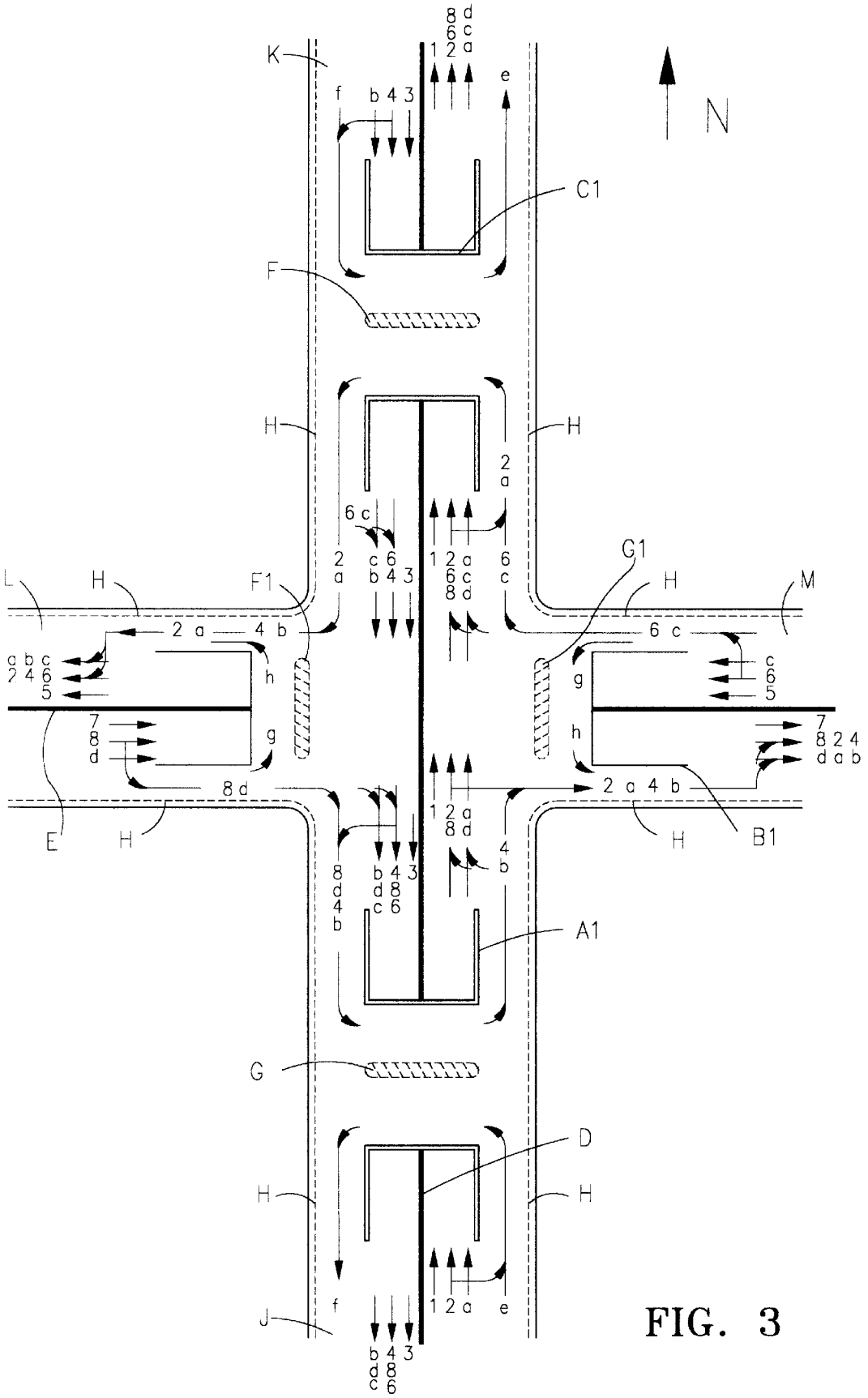
FIG. 3 is a plan view of the traffic guide constructions of FIG. 2 and the traffic tracks of cars for right side driving.
Figure 4:
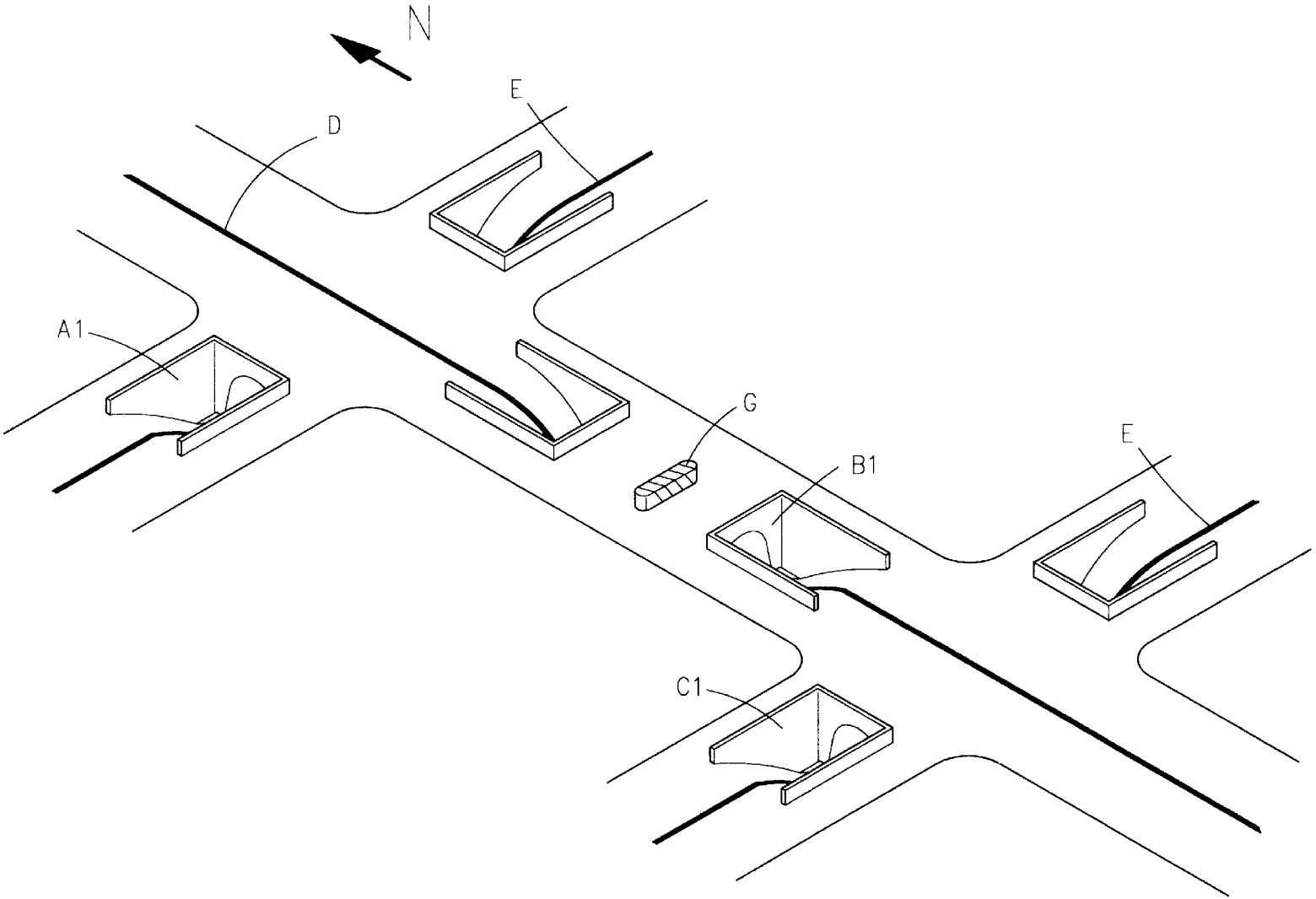
FIG. 4 is a schematic perspective view illustrating the traffic guide constructions at two continuous road intersections.

Please refer to FIGS. 1, 2 and 4 which are schematic perspective views separately illustrating an embodiment of traffic guide constructions at road intersections according to the present invention. As shown, there is a main road JK extending from north to south and a branch road ML extending from east to west to intersect with the main road JK. Both the main and the branch roads JK and ML have two traffic lanes divided by lines D and E, respectively. In a first embodiment as shown in FIG. 1, there is a first overhead bridge B extending in a direction parallel to the branch road ML and across the intersection of the branch road ML with the main road JK, and a second and a third overhead bridges A, C constructed on and in parallel with the main road JK separately near each side of the first overhead bridge B on the branch road ML. All the overhead bridges A, B, C have a tunnel below them. Underground passages I are built for pedestrian only. And, in a second embodiment as shown in FIG. 2, there is a first underground tunnel B1 extending in a direction parallel to the branch road ML and across the intersection of the branch road ML with the main road JK, and a second and a third underground tunnels A1, C1 constructed below and in parallel with the main road JK separately near each side of the first underground tunnel B1 of the branch road ML. Overhead bridges W, X, Y, and Z are built for pedestrian only. Turnaround islands G, F are provided on the main road JK to be centered and located above and between two entrances of the underground tunnels A1, C1, respectively, forming a second and a third turnarounds on the main road JK above the second and the third underground tunnels A1, C1. Another turnaround islands G1, F1 are provided on the branch road ML to be centered and located above each entrance of the first underground tunnel B1 without interfering with the main road JK, forming two first turnarounds on the branch road ML above the first underground tunnel B1. Both the main road JK and the branch road ML are provided at two road sides with road guards H (see FIGS. 3 and 5) to separate cars from pedestrians. Stairs of the underground passages I and of the overhead bridges W, X, Y and Z can be replaced with escalators, too.

With the overhead bridges A, C and B or the underground tunnels A1, C1 and B1 constructed on the main road JK and the branch road ML, respectively, following methods of traffic control can be provided:

A. For right side driving:

a. As shown in FIG. 1, cars on the main road JK and the branch road ML may go straight across the intersection without interruption by way of the overhead bridges A, C, and B, respectively, and turn around by way of the tunnels below the bridges A, C and B. Or, in the case as shown in FIG. 2, cars on the main road JK and the branch road ML may go straight through the intersection without interruption by way of the underground tunnels A1, C1 and B1, respectively, and make U-turns at the turnarounds above the underground tunnels A1, C1, and B1, respectively.

b. Cars on the main road JK and the branch road ML can make a right turn to the adjacent branch road and main road, respectively, by early changing their lanes to an outer lane.

c. Cars on the main road JK wanting to turn left to the branch road ML may change to an outer lane and directly pass across the intersection without going through the overhead bridge or the underground tunnel, and then make a left U-turn at the tunnel or the turnaround of the second or the third overhead bridge or underground tunnel into an opposite outer lane, and then make a right turn to the branch road ML at the intersection.

d. Cars on the branch road ML wanting to turn left to the main road JK may change to an outer lane and then make a right turn to the main road JK at the intersection. The cars keep moving and make a left U-turn at the tunnel or turnaround of the second or the third overhead bridge or underground tunnel to an opposite outer lane, and then proceed straight on the main road JK.

e. Cars moving straight on the main road JK or the branch road ML may make a U-turn to an opposite lane by way of the tunnels or the turnarounds of the overhead bridges A, C, B or underground tunnels A1, C1, B1, respectively.

A motorcycle lane may be specially provided on the roads for motorcycles to use in the same rules as above mentioned.

B. For left side driving:

a. As shown in FIG. 1, cars on the main road JK and the branch road ML may go straight across the intersection without interruption by way of the overhead bridges A, C, and B, respectively, and turn around by way of the tunnels below the bridges A, C and B. Or, in the case as shown in FIG. 2, cars on the main road JK and the branch road ML may go straight through the intersection without interruption by way of the underground tunnels A1, C1 and B1, respectively, and make U-turns at the turnarounds above the underground tunnels A1, C1, and B1, respectively.

b. Cars on the main road JK and the branch road ML can make a left turn to the adjacent branch road and main road, respectively, by early changing their lanes to an outer lane.

c. Cars on the main road JK wanting to turn right to the branch road ML may change to an outer lane and directly pass across the intersection without going through the overhead bridge or the underground tunnel, and then make a right U-turn at the tunnel or the turnaround of the second or the third overhead bridge or underground tunnel into an opposite outer lane, and then make a left turn to the branch road ML at the intersection.

d. Cars on the branch road ML wanting to turn right to the main road JK may change to an outer lane and then make a left turn to the main road JK at the intersection. The cars keep moving and make a right U-turn at the tunnel or turnaround of the second or the third overhead bridge or underground tunnel to an opposite outer lane, and then proceed straight on the main road JK.

e. Cars moving straight on the main road JK or the branch road ML may make a U-turn to an opposite lane by way of the tunnels or the turnarounds of the overhead bridges A, C, B or underground tunnels A1, C1, B1, respectively.

Please now refer to FIG. 3 which is a plan view of the traffic guide constructions of FIG. 2 and the traffic tracks of cars for right side driving. It is to be recognized that in all cases cars turning onto a road or performing a U-turn must yield the right of way to any oncoming traffic. As shown in the drawing:

a. Cars 1, 2, a; 3, 4, b and 5, 6, c; 7, 8, d are moving straight forward on the main road JK and the branch road ML, respectively.

b. Cars 2, a; 4, b and 6, c; 8, d on the main road JK and the branch road ML, respectively, can make a right turn to the adjacent branch road and main road, respectively, by early changing their lanes to an outer lane.

c. Cars 2, a; 4, b on the main road JK wanting to turn left to the branch road ML may change to an outer lane and directly pass across the intersection without going through the overhead bridge or the underground tunnel, and then make a left U-turn at the tunnel or the turnaround of the second or the third overhead bridge or underground tunnel into an opposite outer lane, and then make a right turn to the branch road ML at the intersection.

d. Cars 6, c; 8, d on the branch road ML wanting to turn left to the main road JK may change to an outer lane and then make a right turn to the main road JK at the intersection. The cars keep moving and make a left U-turn at the tunnel or turnaround of the second or the third overhead bridge or underground tunnel to an opposite outer lane, and then proceed straight on the main road JK.

e. Cars e, f; g, h moving straight on the main road JK or the branch road ML, respectively, may make a U-turn to an opposite lane by way of the tunnels or the turnarounds of the overhead bridges A, C, B or underground tunnels A1, C1, B1, respectively.

Figure 5:
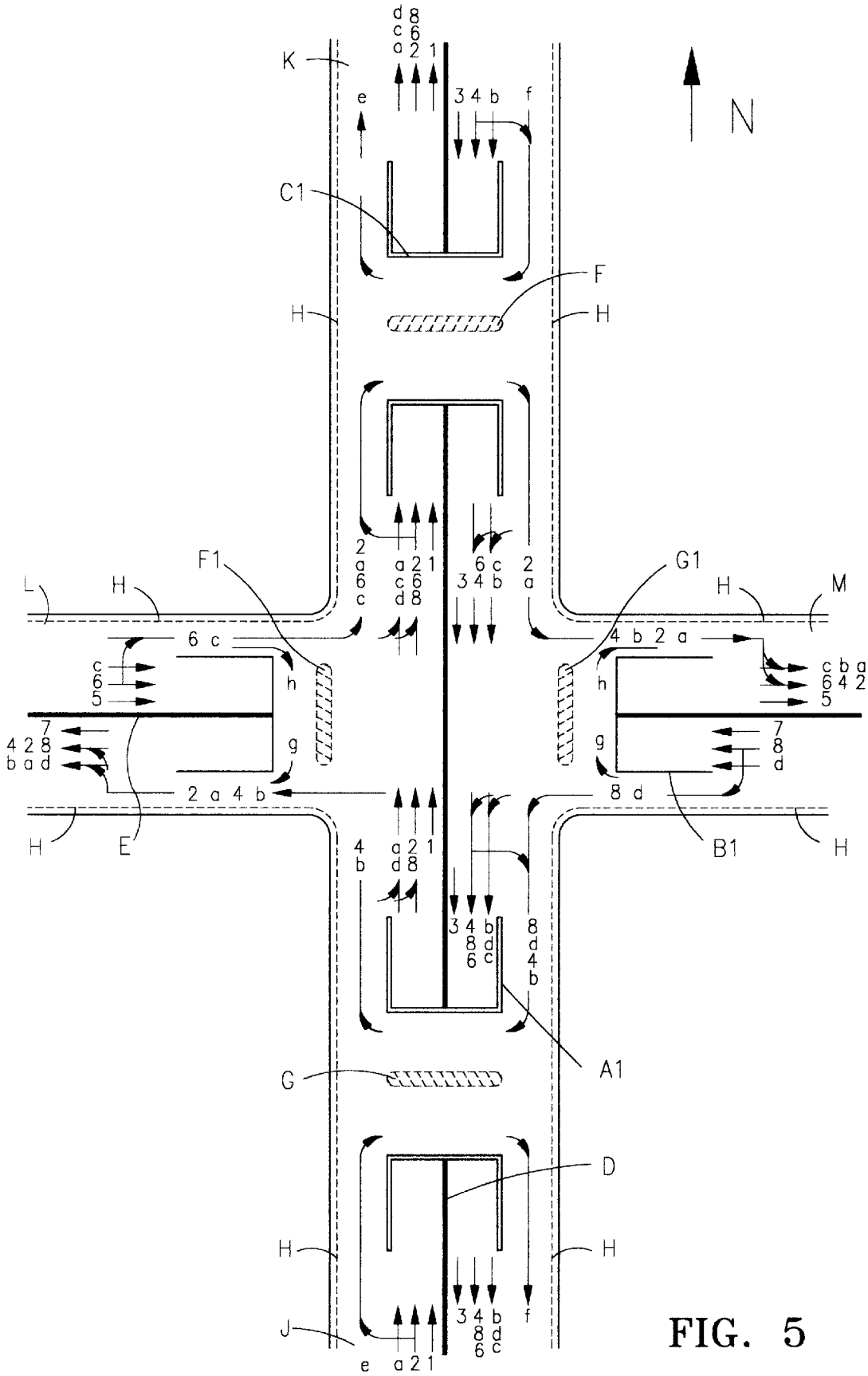
FIG. 5 is a plan view similar to FIG. 3 showing the traffic guide constructions of FIG. 2 and the traffic tracks of cars but for left side driving.

Please now refer to FIG. 5 which is a plan view of the traffic guide constructions of FIG. 2 and the traffic tracks of cars for left side driving. It is to be recognized that in all cases cars turning onto a road or performing a U-turn must yield the right of way to any oncoming traffic. As shown in the drawing:

a. Cars 1, 2, a; 3, 4, b and 5, 6, c; 7, 8, d are moving straight forward on the main road JK and the branch road ML, respectively.

b. Cars 2, a; 4, b and 6, c; 8, d on the main road JK and the branch road ML, respectively, can make a left turn to the adjacent branch road and main road, respectively, by early changing their lanes to an outer lane.

c. Cars 2, a; 4, b on the main road JK wanting to turn right to the branch road ML may change to an outer lane and directly pass across the intersection without going through the overhead bridge or the underground tunnel, and then make a right U-turn at the tunnel or the turnaround of the second or the third overhead bridge or underground tunnel into an opposite outer lane, and then make a left turn to the branch road ML at the intersection.

d. Cars 6, c; 8, d on the branch road ML wanting to turn right to the main road JK may change to an outer lane and then make a left turn to the main road JK at the intersection. The cars keep moving and make a right U-turn at the tunnel or turnaround of the second or the third overhead bridge or underground tunnel to an opposite outer lane, and then proceed straight on the main road JK.

e. Cars e, f; g, h moving straight on the main road JK or the branch road ML, respectively, may make a U-turn to an opposite lane by way of the tunnels or the turnarounds of the overhead bridges A, C, B or underground tunnels A1, C1, B1, respectively.

With the arrangements of the present invention, the traffic jams usually found on the intersections of a main and a branch roads can be solved while the disadvantages existed in the cited patent can also be avoided. Moreover, the present invention needs only to build overhead bridges and/or underground tunnels without occupying spacious land and needing particularly high construction costs.

What is claimed is:

1. A method of controlling traffic flow at an intersection of a main road comprising multiple lanes in each direction and a branch road comprising multiple lanes in each direction, said method comprising the following steps:

a. providing said intersection with a first overhead bridge extending in a direction parallel to said branch road and across said intersection of said branch road with said main road, and a second overhead bridge and a third overhead bridge constructed on and in parallel with said main road separately near each side of said first overhead bridge on said branch road, said first, second, and third overhead bridges each have a tunnel below said bridge;

b. allowing cars on said main road and said branch road to go straight across said intersection without interruption by way of said first, second, and third overhead bridges and make U-turns by way of said tunnels below said overhead bridges;

c. allowing cars on said main road and said branch road to make a turn to an adjacent branch road and an adjacent main road, respectively, to a side the same as the driving side by changing their lanes to an outer lane well before making the turn;

d. allowing cars on said main road wanting to turn to said branch road to a side opposite to the driving side to change to an outer lane and directly pass across the intersection without going through said second and said third overhead bridges, the cars on said main road then make a U-turn at said tunnel below said second or said third overhead bridge into an opposite outer lane, and the cars on said main road then make a turn at said intersection to said branch road at a side the same as the driving side; and e. allowing cars on said branch road wanting to turn to said main road to a side opposite to the driving side to change to an outer lane and then make a turn at said intersection to said main road at a side the same as the driving side, said cars on said branch road then continue moving and make a U-turn at said tunnel below said second or said third overhead bridge to an opposite outer lane, and said cars on said branch road then proceed straight on said main road.

2. A method of controlling traffic flow at an intersection of a main road comprising multiple lanes in each direction and a branch road comprising multiple lanes in each direction, said method comprising the following steps:

a. providing said intersection with a first underground tunnel extending in a direction parallel to said branch road and across said intersection of said branch road with said main road, a second underground tunnel and a third underground tunnel constructed under and in parallel with said main road separately near each side of said first underground tunnel of said branch road; two first turnaround islands being provided on said branch road to be centered and located above each entrance of said first underground tunnel without interfering with said main road, and a second turnaround island and a third turnaround island being provided on said main road, said second and said third turnaround islands are centered and located above and between two entrances of said second underground tunnel and of said third underground tunnel, respectively, and forming a second turnaround and a third turnaround above said second and said third underground tunnels, respectively;

b. allowing cars on said main road and said branch road to go straight across said intersection without interruption by way of said first, said second, and said third underground tunnels and to make U-turns by way of said first, said second, and said third turnarounds above said underground tunnels;

c. allowing cars on said main road and said branch road to make a turn to an adjacent branch road and an adjacent main road, respectively, to a side the same as the driving side by changing their lanes to an outer lane well before making the turn;

d. allowing cars on said main road wanting to turn to said branch road to a side opposite to the driving side to change to an outer lane and directly pass across the intersection without going through said second and said third underground tunnels, said cars on said main road then make a U-turn at said second or said third turnaround above said second or said third underground tunnel into an opposite outer lane, and then said cars on said main road make a turn at said intersection to said branch road at a side the same as the driving side; and e. allowing cars on said branch road wanting to turn to said main road to a side opposite to the driving side to change to an outer lane and then make a turn at said intersection to said main road at a side the same as the driving side, said cars on said branch road then keep moving and make a U-turn at said second or said third turnaround above said second or said third underground tunnel to an opposite outer lane, and then said cars on said branch road proceed straight on said main road.

* * * * *